United States Patent [19]

Tucker

[11] 4,290,241

[45] Sep. 22, 1981

[54] STAVE ASSEMBLIES, STAVES, AND TUBS CONSTRUCTED THEREWITH

[76] Inventor: Robert S. Tucker, P.O. Box 25362, Richmond, Va. 23260

[21] Appl. No.: 12,762

[22] Filed: Feb. 16, 1979

[51] Int. Cl.[3] ..... E04G 11/06; A47B 5/00

[52] U.S. Cl. ..... 52/36; 52/248; 217/76; 4/513

[58] Field of Search ..... 52/36, 248; 4/172, 173 R; 217/76, 80, 88, 96, 90–93, 4

[56] References Cited

U.S. PATENT DOCUMENTS

| | | | |
|---|---|---|---|
| 474,101 | 5/1892 | Sawyer | 217/90 |
| 558,824 | 4/1896 | Maiden | 217/76 |
| 679,583 | 7/1901 | Woodruff | 52/248 |
| 699,602 | 5/1902 | White | 217/93 |
| 918,718 | 4/1909 | Williamson | 217/76 |
| 1,096,373 | 5/1914 | Jones | 52/248 |
| 1,150,209 | 8/1915 | Krieger | 217/76 |
| 1,223,853 | 4/1917 | Cope et al. | 217/76 |
| 1,452,578 | 4/1923 | Van Cott | 52/248 |
| 2,260,652 | 10/1941 | Ashley | 217/4 |

*Primary Examiner*—James L. Ridgill, Jr.

*Attorney, Agent, or Firm*—Schwartz, Jeffery, Schwaab, Mack, Blumenthal & Koch

[57] ABSTRACT

A stave assembly which cooperates with a plurality of staves to form a hot tub wall includes in a preferred embodiment a narrow stave having a projecting support for a seat, shelf, ladder or the like. The narrow stave is abutted by a pair of slats each of which have a chamfered edge for abutting adjacent staves. In other embodiments the stave assembly includes a stave with a support for a seat, step or the like embedded therein.

12 Claims, 10 Drawing Figures

STAVE ASSEMBLIES, STAVES, AND TUBS CONSTRUCTED THEREWITH

TECHNICAL FIELD

This invention relates to staves, stave assemblies and to tubs constructed therewith. More particularly, this invention relates to staves and stave assemblies which are especially useful in constructing wooden bathing tubs which are generally known as "hot tubs".

BACKGROUND AND PRIOR ART

Currently there is increasing interest in large bathing tubs known as "hot tubs" which are filled with hot water to a level sufficiently high for bathers to completely immerse their bodies. These tubs are often large enough to accommodate several people and are generally marketed for home use and enjoyment.

Although hot tubs may be made of any material which will hold water, they are preferably constructed of relatively heavy wooden staves. There are several reasons for this. A primary reason is that wood is a good insulator. Moreover, wood can be dressed to have a surface which is both attractive and pleasant to touch.

Most hot tubs are now sold in kit form. The tubs are assembled from staves arranged peripherally about a circular floor and held in abutment with one another by hoops made from rods or wires. The abutting sides of the staves are chamfered to form bevels so that the staves can be readily arranged in a circular configuration. Seals are effected between each stave as the wood absorbs water causing the staves to expand against one another while being held in abutment by the hoops. Preferably, the staves are made from cyprus or redwood, however, they may be made from teak, if one desires a rather expensive tub, or from other woods.

The staves are generally rather thick in order to insulate hot water within the tubs, in order to enhance the appearance of the tubs and to facilitate assembly of the tubs. Moreover, the staves are generally straight with parallel sides so as to give the tubs a cylindrical shape.

Since hot tubs tend to be relatively deep, getting in and out can be difficult. Accordingly, hot tubs require ladders, steps and decks as well as seats. Preferably, any step or seat placed in the tub is made of wood; however, wood tends to float so that the seat should be anchored to the inner wall of the tub. According to current practice this is accomplished by boring holes through the tub wall and inserting screws or other fasteners through the wall and into the step or seat or a support therefor. This type of fastening has caused problems because of leakage through holes which subsequently require caulking or plugging. Current approaches to the problem of providing accessory structure supports are not satisfactory from either a safety, an aesthetic or an assembly point of view. Accordingly, there is a need for an improved structure to attach accessory structures to hot tubs.

OBJECTS OF THE INVENTION

In view of the foregoing considerations it is an object of the invention to provide new and improved tub staves and tubs constructed therewith.

It is a further object of the instant invention to provide hot tubs with stable, attractive auxiliary structures.

It is a further object of the instant invention to provide hot tubs with supports for auxiliary structures which are integral with the hot tub structure.

It is a further object of the instant invention to provide a new and improved stave for a hot tub or the like wherein the stave includes a projecting support as an integral part thereof.

It is a further object of the instant invention to provide new and improved supports for auxiliary hot tub structures wherein the supports are included in kit components that may be easily assembled by the average purchaser.

It is a further object of the instant invention to provide a new and improved hot tub, which when assembled does not require expenditures for, or installation of, additional structure in order to be a useful and safe device.

It is a further object of the instant invention to provide a new and improved stave for assembly with other staves to form a wall wherein at least a portion of that stave projects from the surface of the wall to form a support or the like.

It is a further object of the instant invention to provide a new and improved support for auxiliary hot tub structures wherein the support is an integral part of a stave and is made from essentially the same stock as other staves used to assemble the tub.

SUMMARY OF THE INVENTION

In view of these and other objects, the instant invention contemplates a stave assembly for combination with other staves to construct a wall of a tub wherein the stave assembly includes a stave having a pair of longitudinally extending side faces and a lateral projection and wherein the assembly further includes a pair of slats for abutment with the side faces whereby when the wall is constructed the projection extends therefrom to form a support.

The instant invention further contemplates a hot tub wall constructed of a plurality of staves wherein at least one stave extends laterally away from the wall of the tub to form a support.

DETAILED DESCRIPTION OF THE PREFERRED EMBODIMENT

Figure 1:
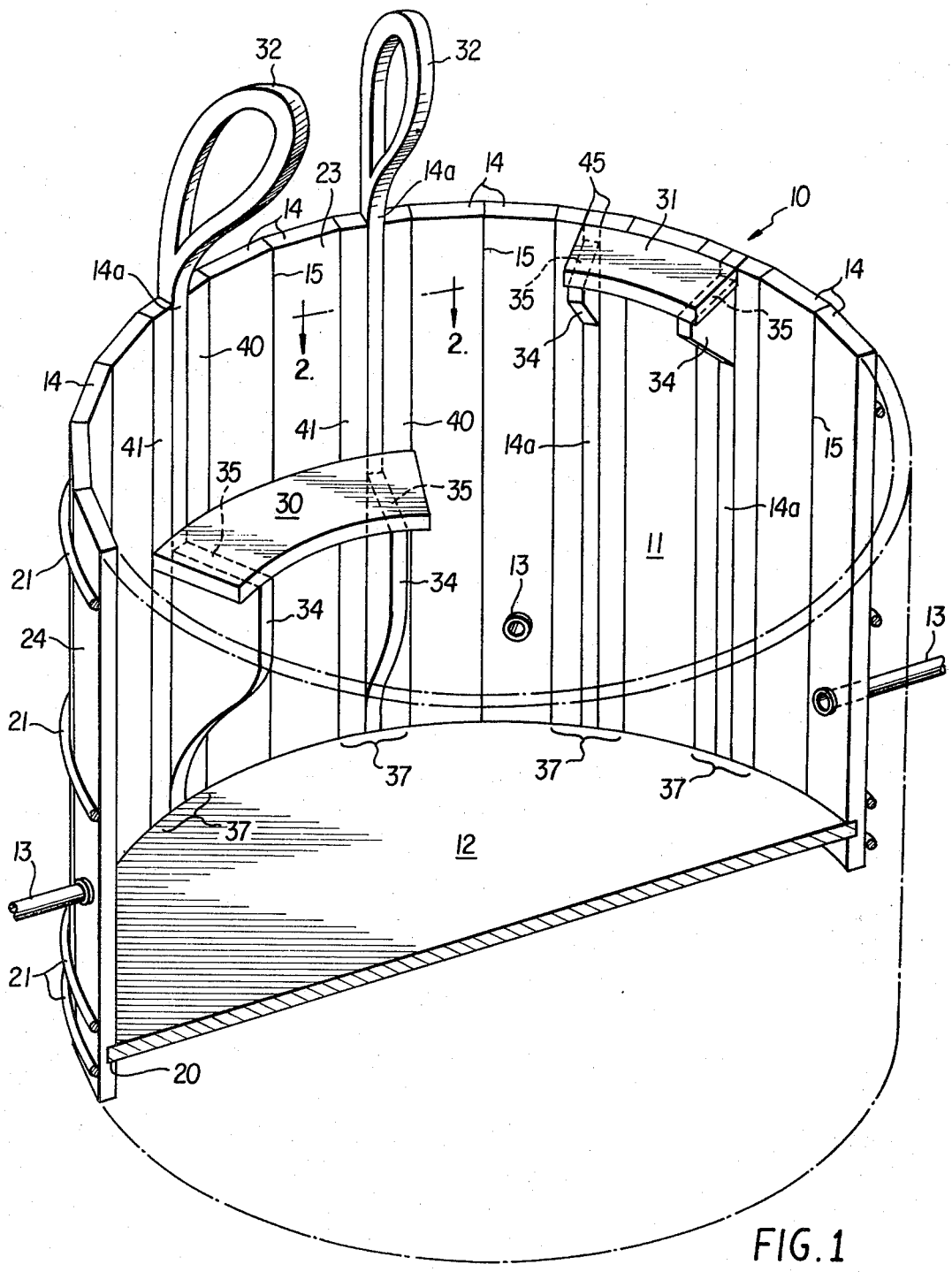
FIG. 1 is a perspective view, partially cut away, showing a hot tub according to the instant invention which utilizes stave assemblies of the instant invention.

Referring now to FIG. 1, there is shown a hot tub 10 constructed in accordance with the instant invention. The hot tub 10 includes a wall 11 and a floor 12 which form a receptacle for retaining water. Preferably, inlet and outlet lines 13 pass water through the hot tub 10 in accordance with well known procedures in which water is circulated by a pump through a filter and heater (not shown) and/or chlorinator (not shown).

The wall 11 of the hot tub 10 is assembled by abuting staves 14 against one another at seams 15 to provide a wall of substantially uniform thickness. The floor 12 is conveniently made from joined planks and is seated within a croze 20 cut into each of staves 14 a short distance from the lower end of each stave. The staves 14 are held in abutment with one another by rod hoops 21 which are tightened around the staves 14 by screw lugs or the like (not shown). Ideally, no caulking is needed because the staves 14 swell to close the seams 15 as the wood from which the staves are made absorbs water from the bath.

Figure 2:
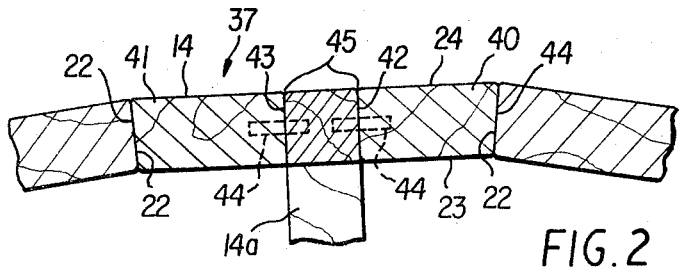
FIG. 2 is an enlarged cross section of a stave and stave assembly in accordance with the instant invention taken along lines 2—2 of FIG. 1.

As is seen in FIG. 2, each stave 14 is chamfered along two sides thereof to form beveled faces 22 which abut beveled faces 22 of adjacent staves 14. The angle that the beveled faces 22 make with interior and exterior surfaces 23 and 24, respectively, of the staves 14 is determined by the number of staves used and the width of the staves. For example, if each stave is made from a "2×6" then a five foot diameter tub would require each stave to have one beveled face 22 chamfered at plus one and one-half degrees and the other beveled face 22 chamfered at minus one and one-half degrees. Generally, the narrower the staves 14, the smaller the angle of the bevels 22 will be for a tub 10 of a given diameter.

Figure 5:
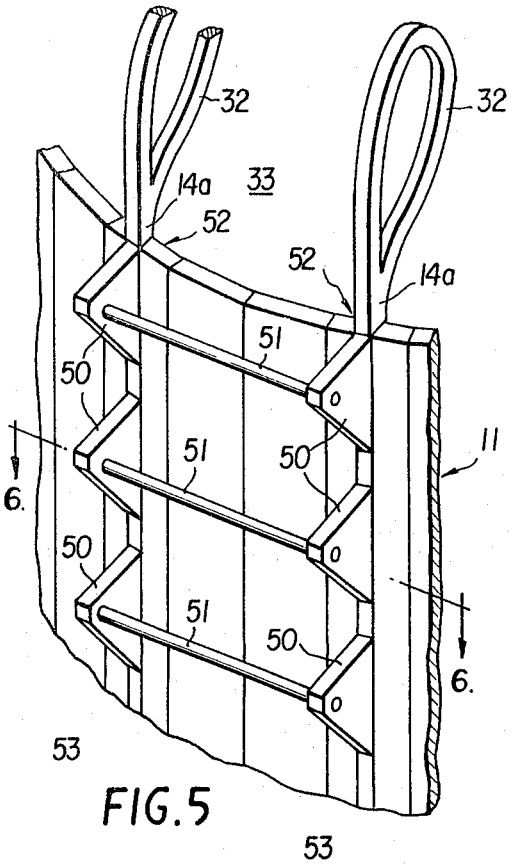
FIG. 5 is a partial perspective view showing an exterior ladder for a hot tub utilizing stave supports in accordance with the principles of the instant invention.
Figure 6:
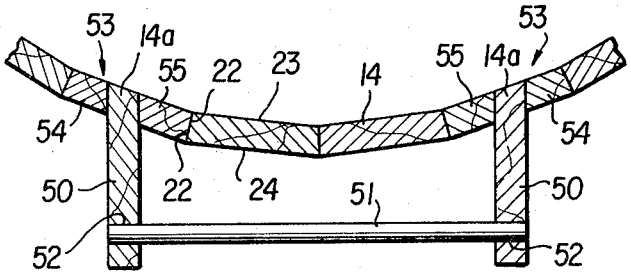
FIG. 6 is an enlarged sectional view taken along lines 6—6 of FIG. 5.
Figure 7:
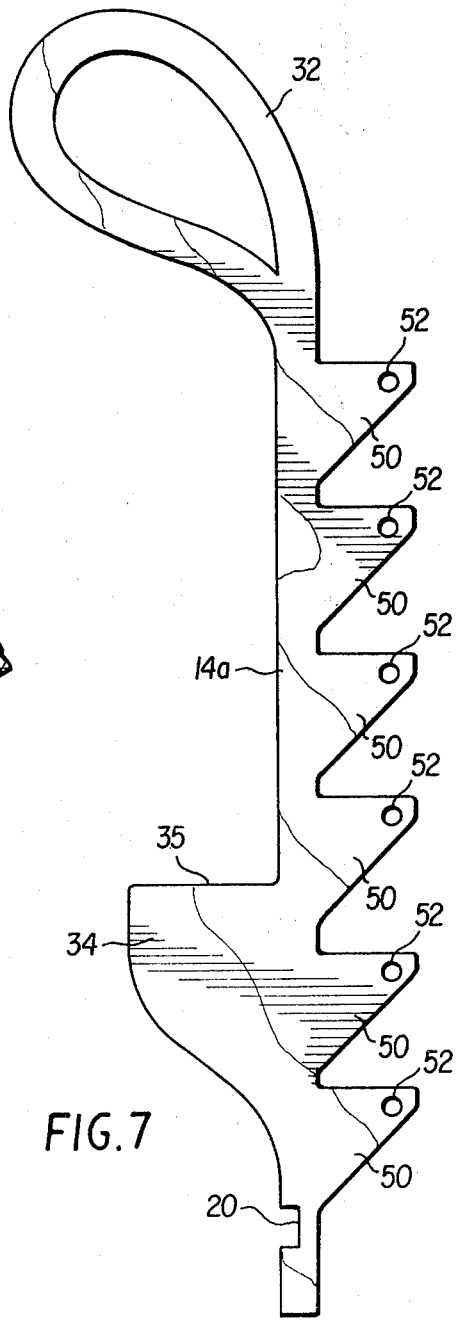
FIG. 7 is an enlarged side view of a stave or portion of a stave assembly having projecting support structures thereon.

In order to improve the safety and convenience of hot tubs, such as the tub 10, it is advantageous to provide auxiliary structures such as the seat 30, the shelf 31 and the loops 32 shown in FIG. 1 and the ladder 33 shown in FIGS. 5–7. These auxiliary structures are necessary because hot tubs are preferably at least four feet high in order to permit a bather to complete immerse in the tub without lying down. The ladder 33 and loops 32 permit bathers to climb over the top edge of the tub 10 while the seat 30 serves as a platform allowing bathers to slowly immerse themselves in the hot water so that their bodies can become adapted to the water.

Instead of loops 32, or in addition thereto, there may be provided other supporting structures which serve, for example, to support a roof or convering for the hot tub, or provide a privacy screen or the like. In fact, the loops may be replaced by a design serving a purely esthetic function or may also serve as a screening function.

Auxiliary structures such as the seat 30 and shelf 31 require supports. In accordance with a preferred embodiment of the instant invention, this is accomplished by modifying selected staves to form narrow staves 14*a* to provide integral projecting portions 34 which have support surfaces 35 to which auxiliary structures such as the seat 30 or shelf 31 may be attached. The narrow staves 14*a* are cut from lumber stock having substantially the same thickness as the other staves 14 by sawing the stock normal to its width according to a desired pattern. In the preferred embodiment, the projecting portions 34 are integral with the staves 14*a* and therefore need not be secured thereto by screws, adhesives, dovetailing or other arrangements.

Figure 3:
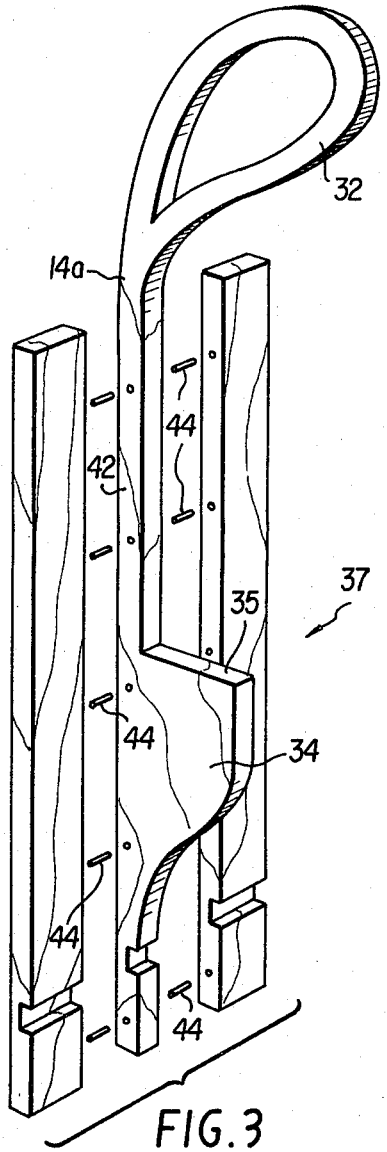
FIG. 3 is an exploded view in perspective of a stave assembly constructed in accordance with the principles of the instant invention.

In accordance with a preferred embodiment, each stave 14*a* is incorporated in stave assembly 37 such as that shown in exploded perspective in FIG. 3 and in cross section in FIG. 2. The assembly 37 is constructed by positively securing slats 40 and 41 to longitudinally extending faces 42 and 43 of the stave 14*a* with pegs 44. Instead of using the pegs 44, other rod members such as metal screws or bolts or even adhesives may be used. In any event, there is a seam 45 between the stave 14*a* and slats 41 and 40 which closes when the stave assembly 37 is exposed to water within the tub 10. The stave assembly 37 can be provided as a unitary structure when marketing the tub 10 in kit form.

Since the stave 14*a* is preferably cut from the same stock as the other staves 14, it has a dimension between the two faces 42 and 43 which is equal to the thickness of the other staves and to the thickness of the wall 11. Due to the projection 34, the staves 14*a* also has a dimension greater than the thickness of the slats 40 and 41 and the wall 11 so that the stave projects laterally past the surfaces of the slats and wall while the side faces 42 and 43 are within the wall.

As is seen in FIGS. 1 and 2, the seams 45 extend generally normal to the inner and outer wall surfaces 23 and 24 incorporated in the stave assembly 37 so that the projecting portions 34 are within the parallel planes defining the longitudinally extending side faces 42 and 43 and extend radially toward the center of the tank 10.

The seat 30 and shelf 31 are generally formed as arcuate segments which conform to the curvature of the tub wall 11. Although only two supports 34 are shown for the seat 30 and for the shelf 31, it should be kept in mind that additional supports can be added, if needed, in order to increase the lengths of the seat 30 or shelf 31.

Referring now to FIGS. 5, 6 and 7, where the exterior ladder 33 is shown, the staves 14*a* have exterior projections 50 thereon which serve to support ladder rungs 51 in bores 52 in the projections 50. In this embodiment each stave 14*a* may also have a loop 32 and a seat supporting projection 34. Furthermore, in this embodiment each stave 14*a* is preferably incorporated in a stave assembly 53. As is seen in FIG. 6, each stave assembly 53 differs from the stave assembly 37 of FIG. 2 in that, in stave assembly 53 the stave 14*a* is disposed between slats 54 and 55 at an angle aligning the staves with parallel chords of the circle generally defined by the wall 11 of the tub 10. Consequently, the rungs 51 forming the ladder 33 can be straight and oriented perpendicularly to the projections 50, resulting in a ladder 33 which is relatively easy to assemble and has a pleasing appearance. In constructing the stave assemblies 53, pegs, bolts, screws or adhesives may be used in the same manner as used in constructing the assembly 37.

While it is preferred to configure the staves 14*a* having projecting portions in a stave assembly, it is also part of this invention to simply insert the staves 14*a* in the array of other staves 14 without first incorporating the staves 14*a* in an assembly.

Figure 4:
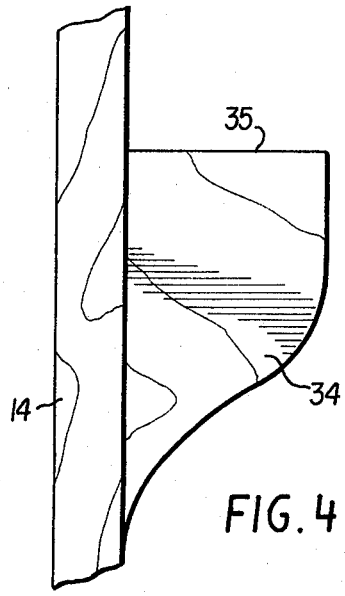
FIG. 4 is a fragmentary side view of the stave assembly of FIG. 3.
Figure 8:
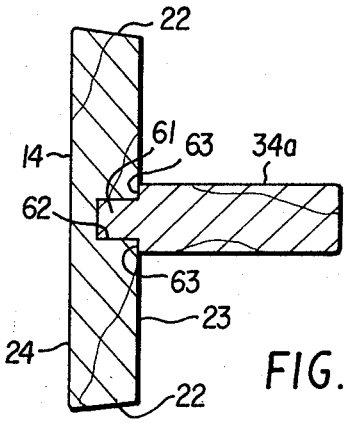
FIGS. 8–10 are sectional views, taken through FIG. 4, of the stave assembly embodiment showing support structures embedded within staves.
Figure 9:
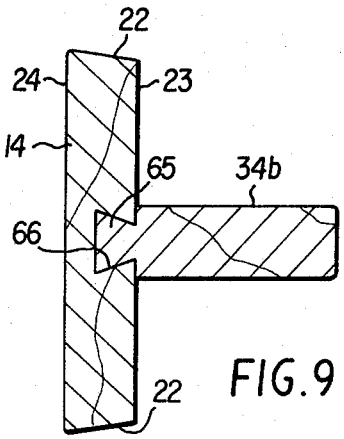
Figure 10:
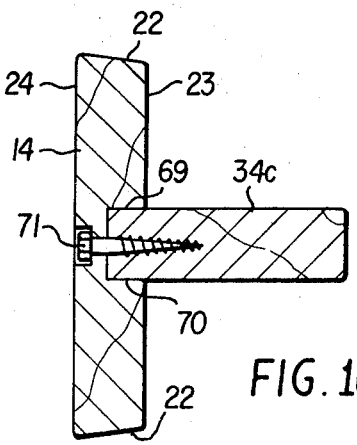

FIGS. 8, 9 and 10 show additional embodiments of the instant invention wherein the projection 34 shown in FIG. 4 is retained within slots in a stave 14. In FIG. 8, a support 34*a* is mounted on the stave 14 by a projecting retaining portion 61 which seats in a groove 62. The retaining portion 61 is rectangular and has a cross section less than the support 34*a* so as to create a pair of shoulders 63 which abut the inside surface 23 of the stave 14 in order to form a stable joint between the stave and support.

In FIG. 9 a support 34*b* has a retaining portion 65 thereon which has diverging beveled sides that dovetail with converging beveled sides of a groove 66 to form a stable joint. The groove 66 opens upwardly to a relatively wide cross section (not shown) or to the top of the stave 14 so that the retaining portion 65 may be slid down thereinto.

In FIG. 10 a support 34*c* has a retaining portion 69 thereon received in a groove 70. The retaining portion 69, support 34*c* and groove 70 have approximately the same cross-sectional area so that the support is stabilized by the groove. A screw 71 passed through the exterior surface 24 retains the support 34*c* in place and projecting from the interior surface 23.

While particular embodiments of the present invention have been herein illustrated and described, it is not intended to limit the invention to such disclosure, but changes and modifications may be made herein and thereto within the scope of the following claims.

What is claimed is:

1. A hot tub comprising:

(a) a plurality of staves forming a wall for said tub, (b) a bottom, (c) a pair of support staves, each support stave having longitudinally extending side faces and an inwardly, laterally extending projection, (d) each projection having a support surface positioned intermediate the bottom of said tub and the top of said stave for supporting a seat, (e) each of said support staves formed of a single fabricated board, (f) said pair of support staves spacedly positioned in the wall of said tube for forming a portion thereof, and (g) a seating board having ends thereof supported by the support surfaces of said stave projections for forming said seat.

2. A hot tub as recited in claim 1 wherein, the wall has a substantially uniform thickness and wherein the distance between opposite side faces of said support stave is substantially equal to the thickness of the wall, whereby the support stave is formed from lumber stock having the same thickness as said plurality of staves forming the wall.

3. A hot tube as recited in claim 1 or 2, wherein said support stave has a projection extending away from and exterior to the tub wall for supporting a rung of a ladder, said stave, including said rung support projection, formed of a single fabricated board.

4. A hot tub as recited in claim 1, wherein at least one of said staves has side faces extending longitudinally beyond the top of said tube wall and laterally away from the wall of said tub to form a hand-hold projection.

5. A hot tub as recited in claim 4, wherein said stave having said hand-hold projection is formed of a single fabricated board.

6. A hot tub as recited in claim 5, wherein said stave having said hand-hold projection is one of said pair of support staves.

7. A hot tub as recited in claim 6, further comprising a second stave having side face extending longitudinally beyond the top of said tub wall and laterally away from the wall of said tub to form a hand-hold projection.

8. A hot tub as recited in claim 7, wherein said second stave with said hand-hold projection is formed of a single fabricated board.

9. A hot tub as recited in claim 8, wherein said second stave having said hand-hold projection is the other of said pair of support staves.

10. A hot tub comprising:

(a) a plurality of staves forming a wall of said tub, (b) a bottom, and (c) at least one stave having a hand-hold projection extending longitudinally beyond the top of said tub wall and laterally away from the wall of said tub to form a support for entry into an exit from the tub.

11. A hot tub as recited in claim 10, wherein said hand-hold projection extends laterally inwardly to the tub wall.

12. A hot tub as recited in claim 10 or 11, wherein said hand-hold projection and said stave are formed of a single fabricated board.

* * * * *